US010500455B1

(12) United States Patent
Cavill et al.

(10) Patent No.: US 10,500,455 B1
(45) Date of Patent: Dec. 10, 2019

(54) FLEXIBLE GRIP FOR A GOLF CLUB PUTTER SHAFT

(71) Applicant: Eaton Intelligent Power Limited, Dublin (IE)

(72) Inventors: Gregory William Cavill, Pinehurst, NC (US); Billy Dee Wood, Whispering Pines, NC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/038,342

(22) Filed: Jul. 18, 2018

(51) Int. Cl.
*A63B 53/14* (2015.01)
*A63B 60/14* (2015.01)
*A63B 53/00* (2015.01)

(52) U.S. Cl.
CPC ..... *A63B 53/14* (2013.01); *A63B 53/007* (2013.01); *A63B 60/14* (2015.10); *A63B 2209/00* (2013.01)

(58) Field of Classification Search
CPC ..... A63B 53/14; A63B 60/14; A63B 60/12; A63B 53/007; A63B 2209/00
See application file for complete search history.

(56) References Cited

U.S. PATENT DOCUMENTS 4,365,807 A * 12/1982 Melby ..... A63B 60/22 473/295
5,686,158 A * 11/1997 Gibbon ..... A63B 53/14 428/36.92
5,749,792 A * 5/1998 Engfer ..... A63B 53/14 473/300
5,782,705 A * 7/1998 Solari ..... A63B 53/007 473/300
D399,282 S * 10/1998 Jarrett ..... D21/756
7,306,526 B2 12/2007 Baek
7,947,206 B2 * 5/2011 Chen ..... A63B 53/14 264/247
8,342,983 B1 * 1/2013 Jeffres ..... A63B 47/02 473/242
9,421,439 B2 * 8/2016 McLoughlin ..... A63B 60/34
2007/0026959 A1 2/2007 Boone
2007/0259732 A1 11/2007 Billings et al.
2018/0290033 A1 * 10/2018 Rife ..... A63B 60/24

FOREIGN PATENT DOCUMENTS

DE 102011120059 A1 * 6/2013 ..... A63B 53/14
JP 08252347 A * 10/1996 ..... A63B 53/14
JP 11-319172 * 11/1999
JP 2005-078080 * 2/2005
JP 2006-223817 * 8/2006

* cited by examiner

*Primary Examiner* — Stephen L Blau
(74) *Attorney, Agent, or Firm* — Fay Sharpe LLP

(57) ABSTRACT

A flexible grip for the shaft of a putter having the upper face raised in the upper region adjacent the butt end and the raised portion tapered toward the lower end. The upper face has a flat surface in transverse section along the length of the lower part of the grip which has a constant taper. The lower face is straight along the length of the grip and of uniform thickness. The side faces are tapered consistent with taper of the lower section of the grip.

5 Claims, 5 Drawing Sheets

FLEXIBLE GRIP FOR A GOLF CLUB PUTTER SHAFT

BACKGROUND

The present disclosure relates to a flexible grip for the shaft of a golf club and particularly for the shaft of a putter. The stroke employed for putting differs substantially from that of a full swing club; and, accordingly a different engagement of the user's hands with the club grip is required in order to effect a desirable accurate putting stroke. In this regard, it is necessary to maintain consistency and to eliminate unwanted and inconsistent movement. In order to accomplish this, it is necessary for the user to keep the fingers, hands, and wrists locked into a position relative to the arms throughout the entire putting stroke. With the fingers, hands, and wrist locked relative to the arms, the desired movement of the putter is accomplished by rotation of the arms and shoulders around the axis of the spine. However, for the less accomplished or average golfer, keeping the various parts of the hands locked into position relative to the arms has been found to be the most difficult aspect of the putting stroke for obtaining consistent accuracy of putting. In this regard, the user's two hands must work together as a single entity during the putting stroke which requires that the user gain sufficient muscle memory to lock the wrists and hands to provide the desired consistent motion. Typically, only professional or better golfers are able to do this because they have built up their muscle memory to make their hands more stable during the stroke; whereas, average golfers tend to put the hands and fingers in a more natural or relaxed position which fails to maintain stability during the putting stroke. In particular, better golfers have trained themselves to keep their finger positions and wrists stable during the putting stroke.

Heretofore, flexible grips for the shaft of a putter have utilized longitudinal curvature of the grip and an enlarged portion adjacent the closed end of the grip on the lower surface sometimes referred to as a "pistol" grip. As shown in FIG. 13, a flexible grip of the prior art, indicated generally at 1, is received on the shaft 2 of a putter and has the upper face 3 moved along the shaft and the lower face extended downwardly at 4 adjacent the closed end 5.

In the traditional reverse overlap style of gripping the club as shown in FIG. 10, the lower hand thumb pad rests on top of the thumb of the upper hand. For this common style of gripping a putter, it has been desired to provide an increased wrist angle that is less natural and which reduces dexterity of the hands on the grip. The pistol type grip has decreased the ulnar deviation of the wrist angle and the angle of the fingers relative to the shaft axis which has resulted in decreased ability to maintain stability and consistency of the putting stroke.

Thus, it has been desired to provide the configuration for the flexible grip for the shaft of a putter which aids in the user gripping the club in a manner which will result in stability of the movement of the wrist and arms and increased consistency, thus greater accuracy of the putting stroke.

SUMMARY

In order to improve the ability of the golfer to maintain a stable grip and movement of a putter during the putting stroke, the grip of the present disclosure provides a configuration which increases the ulnar wrist angle and creates a position that is less natural and reduces the dexterity of both hands and fingers.

The flexible grip of the present disclosure employs a raised portion on the upper face of the grip adjacent the closed or butt end, which tapers longitudinally toward the open end of the grip. This configuration tends to increase the ulnar deviation of the hands and to stabilize the hands and forearm during the putting stroke. The raised portion of the flexible grip of the present disclosure has the thumb pad of the upper hand resting on the upper face of the grip resulting in increased ulnar deviation of the hands causing both forearms to be more in line with each other, thereby retaining a more equal wrist angle which improves unity during the putting stroke. This arrangement causes the grip to be gripped closer to the base of the fingers as opposed to the fingertips, thereby reducing finger dexterity and movement.

The lower face of the grip of the present disclosure has a constant thickness linear configuration parallel to the putter shaft which gives a consistent feel within the user's fingers and causes the fingers to be in a more planar configuration. The flat surface on the upper face is a more stable resting point for the thumb and prevents placing the thumbs over to one side of the grip, thereby causing the putter face not to be perpendicular with the intended trajectory.

The side faces of the grip are tapered equally; and, the lower portion of the upper face, that is the portion that is not raised, has a taper rate which is consistent or equal to the rate of taper of the side faces of the grip. In one version of the grip of the present disclosure, the raised portion of the top face is raised an amount of about 20 mm within the upper span of about 110 mm of the grip length which creates an increased wrist angle of about ten degrees (10°) on the upper hand. This results in the wrist angle of the upper hand being more equal that of the lower hand.

DETAILED DESCRIPTION

Referring to FIGS. 1-4, the flexible grip for the shaft of a putter of the present disclosure is indicated generally at 10 and has a tubular member 12, which may be formed of elastomeric material, with an open end 14, shown received over the shaft 16 of a putter. In the present practice, it has been found satisfactory to have the tubular member 12 formed of elastomeric material having a hardness in the range 30-75 on the Shore A scale. The opposite end of the tubular member 12 is substantially closed, as indicated generally at 18, and may include an end cap 20.

Figure 2:
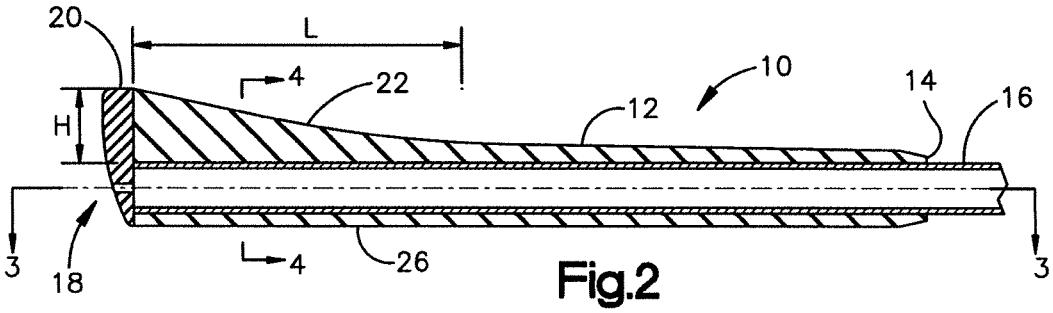
FIG. 2 is a vertical cross section taken through the axis of the putter shaft of FIG. 1.
Figure 3:
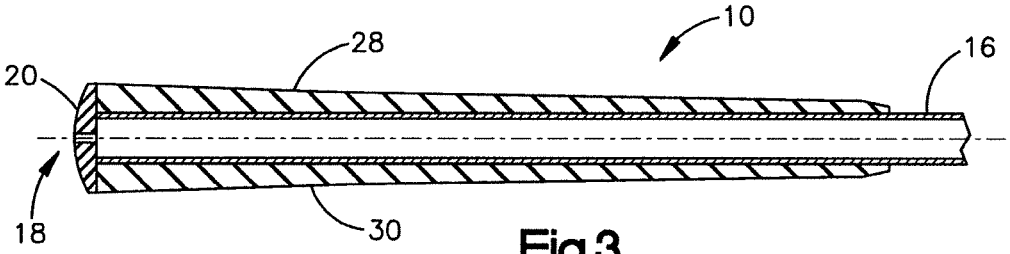
FIG. 3 is a horizontal cross section of the grip of FIG. 1 taken along section lines 3-3 of FIG. 2.
Figure 4:
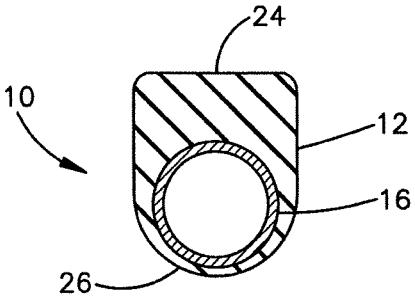
FIG. 4 is a section view taken along section indicating lines 4-4 of FIG. 2.
Figure 5:
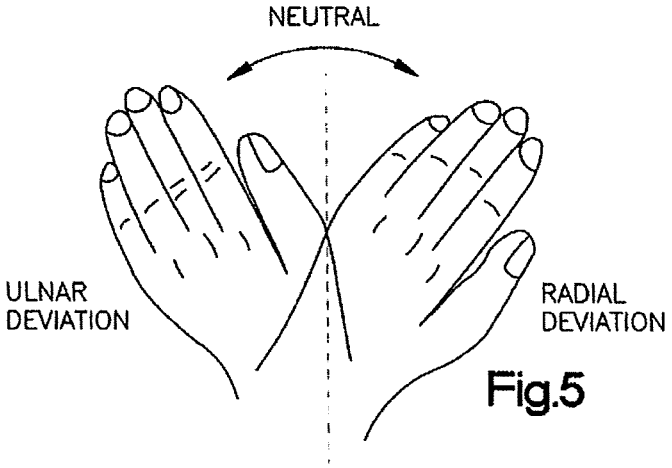
FIG. 5 is a pictorial representation of the deviation of the wrist from neutral in the ulnar direction.

With particular reference to FIGS. 2-4, the region of the tubular member 12 adjacent the end cap 20 is raised by an amount indicated by the reference character "H"; and, the raised portion tapers at a substantially constant rate longitudinally toward the open end, for a distance indicated by the reference character "L", to be coincident with the diameter of the remaining portion of the tubular member. In the present practice, it has been found satisfactory in one version of the grip to have the raised portion 22 extend for about 110 mm and have a height in the range of 0.25-1.25 inches (6.3-31.7 mm). Typically, the raised portion 22 would extend a minimum of one fifth (⅕) of the length of the grip; and, in the present practice, the maximum height considered practical of the raised portion is about 40 mm.

Referring to FIGS. 3 and 4, the upper face of the tubular member 12 has a flat surface 24 formed thereon which extends substantially the width of the grip and along the length of the grip. The flat surface 24 provides a more stable resting point for the thumbs and helps prevent a weak or strong grip where the thumbs are placed over to one side of the putter grip. The flat surface 24 serves to prevent thumbs extending over the side of the grip and prevents orienting the face of the putter in a manner which would not be perpendicular to the intended trajectory of the golf ball.

Figure 6:
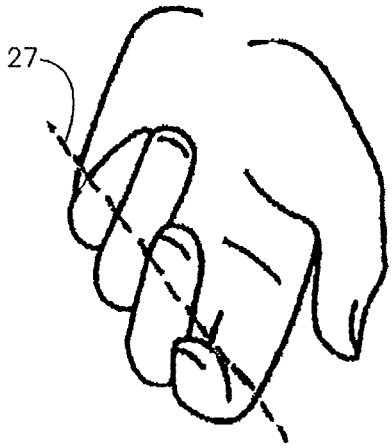
FIG. 6 is a view of the fingers of the user curled about the grip of the present disclosure.
Figure 7:
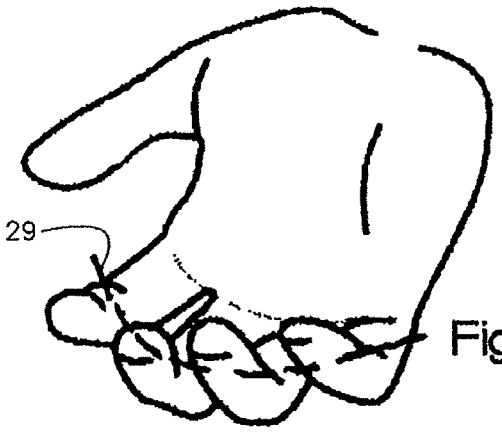
FIG. 7 is a view similar to FIG. 6 of the fingers curled about the typical grip of the prior art.
Figure 8:
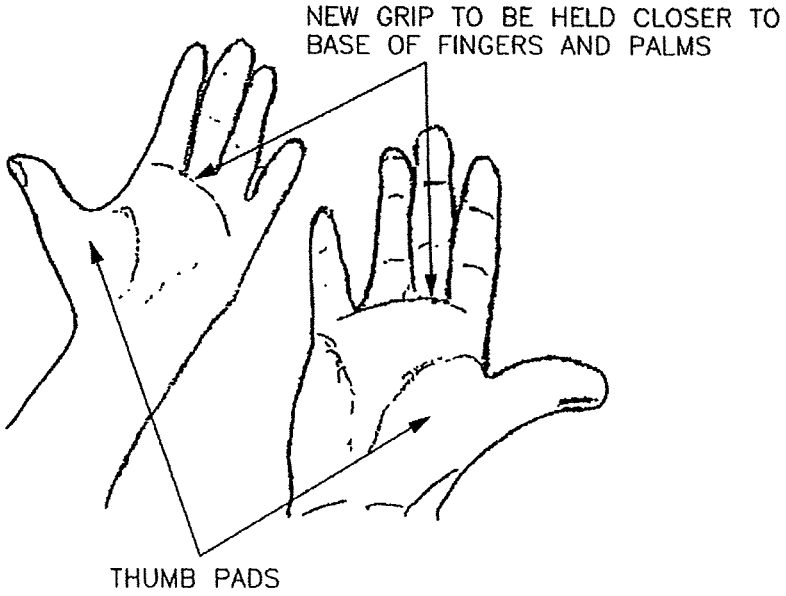
FIG. 8 is a view of the palms of the user's hands showing the area of contact with the grip of the present disclosure.
Figure 9:
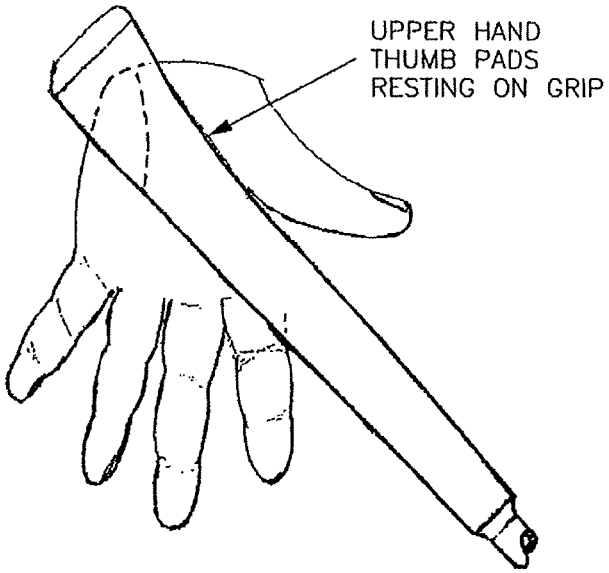
FIG. 9 is a view of the user's hand position for gripping about the grip of the present disclosure.
Figure 10:
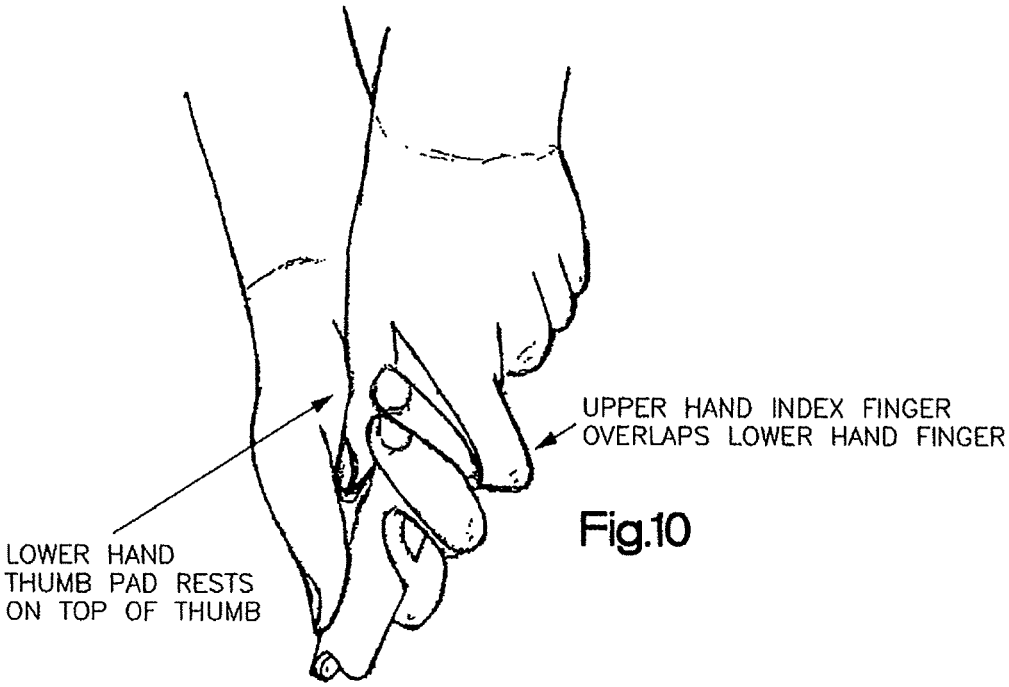
FIG. 10 is an illustration of the traditional overlap style of gripping a putter.

With reference to FIGS. 2-4, the lower face 26 of the tubular member is formed in a straight line, or linearly, and parallel to the surface of the putter shaft 16 with a constant thickness therealong. This produces a more consistent feel within each of the golfers fingers relative to the putter shaft because they are a constant distance from the shaft. This consistent proximity to the putter shaft causes the fingers to be placed in more of a planar position, as shown by dashed line 27 in FIG. 6, along the longitudinal axis of the bottom grip surface, as compared to the more natural arced finger position or curved prior art grips shown by the dashed line 29 in FIG. 7. Moving all the cupped fingers into a more planar arrangement causes the fingers to have less dexterity and therefore introduces less movement, as compared to when the fingers are in a more natural or ergonomic position as shown in FIG. 7.

Figure 1:
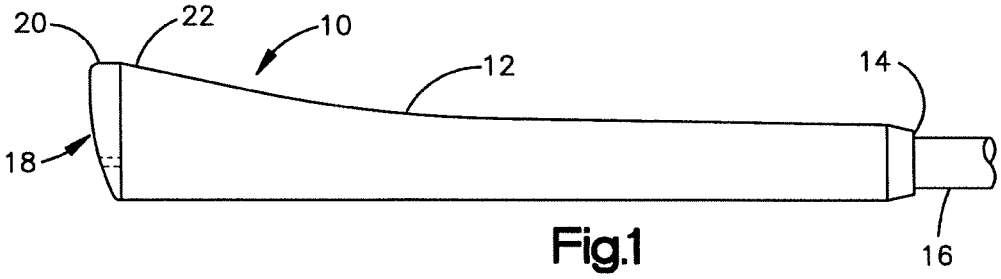
FIG. 1 is a side view of a version of the flexible grip for the shaft of the putter.
Figure 11:
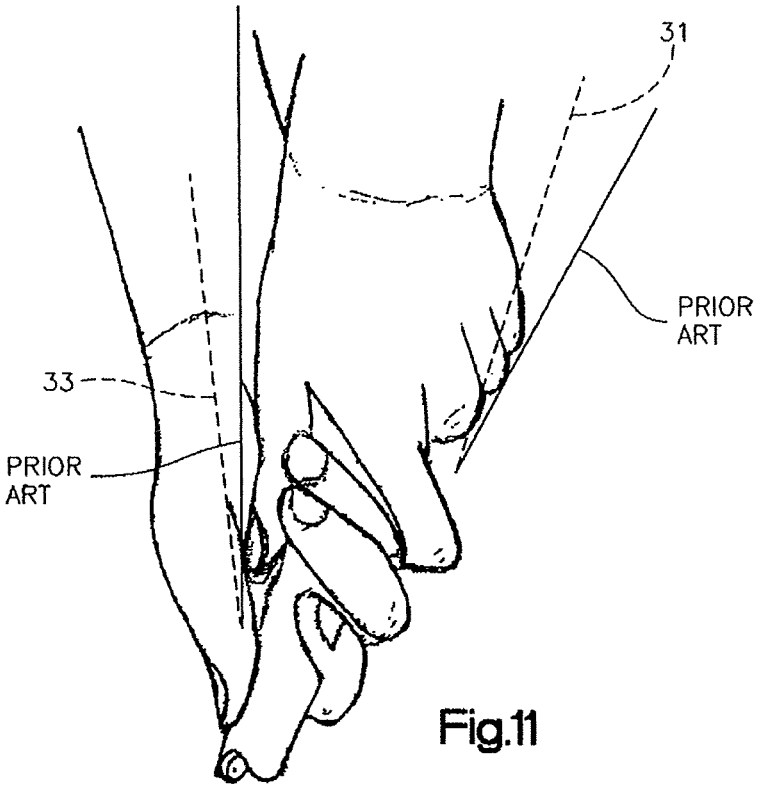
FIG. 11 is a view similar to FIG. 10 showing in solid line the improved positions of the user's hands on the grip of the present disclosure and showing in dashed line the hand positions on the prior art grips.

Referring to FIG. 11 and FIG. 1, the raised upper portion 22 creates an increased wrist angle of about ten degrees (10°) in the upper hand, which is more equal to the wrist angle of the lower hand, which is already increased by this amount due to the thumb pad of the lower hand being placed on top of the upper hand thumb. With particular reference to FIG. 11, the position of the wrist angle of the user gripping prior art putter grips is indicated in solid outline; and, the increased ulnar deviation of the wrist shows the wrist angle increased for the user gripping the grip of the present disclosure in dashed lines 31, 33. This also decreases the angle of fingers relative to the putter shaft axis.

Figure 12:
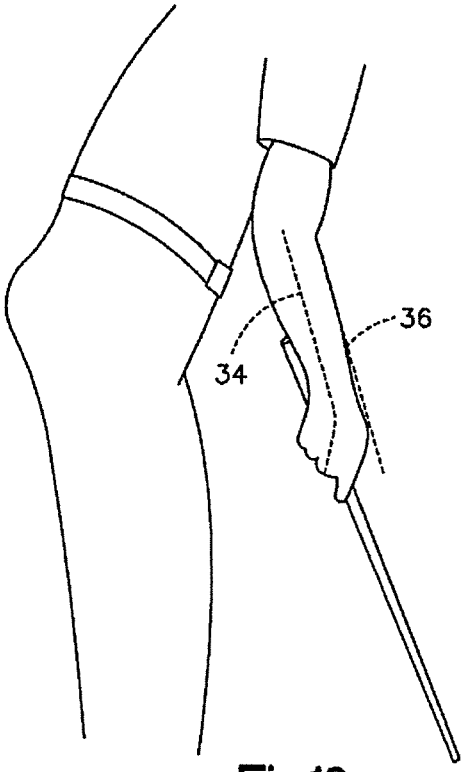
FIG. 12 is an illustration showing a side view of the arm positions of a user gripping a putter having a grip of the present disclosure.
Figure 13:
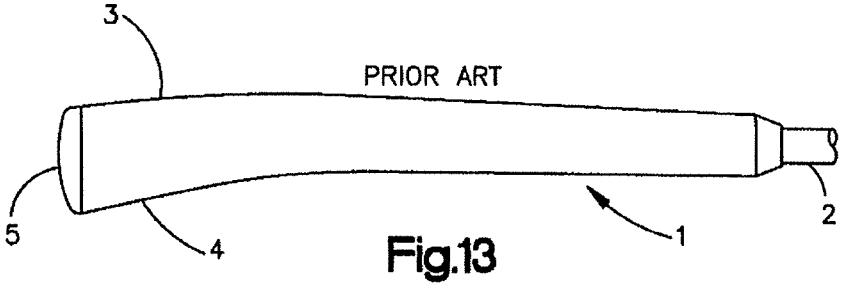
FIG. 13 is a side view of a prior art putter grip employing a curved upper surface and a pistol grip type lower face.

Referring to FIG. 12, as a result of the thumbs being overlapped on top of the raised portion 22 and the increased ulnar deviation, the forearms are caused to lie more parallel and in line with each other as indicated by dashed lines 34, 36.

The side faces of the grip have a constant taper from the substantially closed end to the opened end as indicated by reference numerals 28, 30 in FIG. 3. In the present practice of the invention, it has been found satisfactory to have the constant rate of taper on the grip sides 28, 30 to be consistent with the taper rate of the lower portion of the upper face of the grip below the raised portion.

The present disclosure describes a flexible tubular grip for a golf club putter which has a raised tapered portion formed adjacent the butt end of the grip with a flat surface extending along the upper face of the grip for increasing the angle of ulnar deviation of the wrists of the user upon gripping the club to thereby keep the forearms straight and aid in keeping the wrists and fingers locked during the putting stroke. The lower face of the tubular member is linear and parallel to the axis of the putter shaft to cause the fingers to have a consistent feel and to be placed in more of a planar position, thereby reducing dexterity and effecting less movement of the fingers during the putting stroke.

The exemplary embodiment has been described and illustrated with reference to the drawings. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A flexible grip for a golf putter shaft comprising:

a tubular member formed of elastomeric material having an open end for receiving the shaft and a substantially closed end opposite the open end, the tubular member having:

(a) a portion of the periphery thereof adjacent the substantially closed end on an upper face of the grip toward the toe of the putter having a first angled surface in an upper hand area and a second angled surface on the upper face in a lower hand area angled to a lesser degree than the first angled surface and tapering toward the open end;

(b) the portion of the grip comprising the lower face opposite the upper face of the grip formed linearly and parallel to the putter shaft;

(c) oppositely disposed side surfaces of the grip tapered equally in a direction proceeding from the substantially closed end to the open end;

(d) a first flat surface extending substantially the width of the grip along the upper face along the first angled surface in the upper hand area toward the substantially closed end;

(e) a second flat surface extending substantially the width of the grip on the upper face along the second angled surface in the lower hand area toward the open end;

(f) a uniform wall thickness linearly along the axial length of the grip; and, (g) a region of minimum wall thickness within each transverse cross-sectional area along the length of the grip.

2. The flexible putter grip of claim 1, wherein the tubular member is formed of elastomeric material having a hardness in the range of 30-75 Shore A.

3. The flexible putter grip of claim 1, wherein the grip has a raised portion on the upper face in the upper hand area is raised at an angle that extends to a height in the range of 0.25-1.25 inches (6.3-31.7 mm) above the second flat surface on the upper face in the lower hand area.

4. The flexible putter grip of claim 1, wherein the grip has a raised portion with the first angled portion extends for at least one fifth (⅕) of the length of the tubular member.

5. The flexible putter grip of claim 1, wherein the raised portion with the first angled surface extends to a minimum thickness of about 10 mm.

* * * * *